US006874716B2

(12) United States Patent
Heukamp et al.

(10) Patent No.: US 6,874,716 B2
(45) Date of Patent: Apr. 5, 2005

(54) BEATER BAR CAPABLE OF BEING ACTED UPON ON ONE SIDE FOR IMPACTOR ROTORS

(75) Inventors: Volker Heukamp, Lengerich (DE); Gerhard Hemesath, Havixbeck (DE)

(73) Assignee: Hazemag & EPR GmbH, Duelmen (DE)

( * ) Notice: Subject to any disclaimer, the term of this patent is extended or adjusted under 35 U.S.C. 154(b) by 7 days.

(21) Appl. No.: 09/966,452

(22) Filed: Sep. 28, 2001

(65) Prior Publication Data

US 2002/0053615 A1 May 9, 2002

(30) Foreign Application Priority Data

Sep. 30, 2000 (DE) ..... 100 48 699

(51) Int. Cl.[7] ..... B02C 13/28

(52) U.S. Cl. ..... 241/189.1; 241/191; 241/195; 241/291; 241/300

(58) Field of Search ..... 241/189.1, 191, 241/195, 291, 292.1, 300

(56) References Cited

U.S. PATENT DOCUMENTS

| | | | | |
|---|---|---|---|---|
| 3,146,961 A | * | 9/1964 | Putman, Jr. | 241/191 |
| 3,151,816 A | | 10/1964 | Hanse et al. | |
| 3,202,368 A | * | 8/1965 | Nixon | 241/189.1 |
| 3,784,117 A | * | 1/1974 | Koenig et al. | 241/191 |
| 3,874,603 A | | 4/1975 | Lowe et al. | |
| 4,180,213 A | * | 12/1979 | Endo | 241/192 |
| 4,573,643 A | * | 3/1986 | Orphall et al. | 241/189.1 |
| 5,897,066 A | * | 4/1999 | Bacon et al. | 241/160 |
| 6,129,300 A | * | 10/2000 | Heukamp et al. | 241/191 |

FOREIGN PATENT DOCUMENTS

| | | |
|---|---|---|
| AU | 253 653 | 5/1963 |
| DE | 1 831 058 | 5/1961 |
| DE | 27 59 250 | 7/1979 |
| DE | 16 07 552 | 5/1980 |
| DE | 37 42 395 C1 | 6/1989 |
| GB | 2 020 572 A | 11/1979 |
| GB | 1 558 925 A | 1/1980 |

* cited by examiner

*Primary Examiner*—John M. Husar
(74) *Attorney, Agent, or Firm*—Michael J. Striker

(57) ABSTRACT

A beater bar capable of being acted upon on one side for impactor rotors and insertable form-fittedly into circumferential slots of the rotors has a bend with an elongate cross-section, a bearing surface heldable counter to a centrifugal force of the rotating rotors against a bearing surface of the rotors, a supporting surface engageable with an undercut in the circumferential slot; a piece which holds the beater bar in engagement with the undercut in an circumferential slot, the bend being arcuate, and a center of rotation of a smaller radius of an arc of the bearing surfaces being at a considerable distance from a center of rotation of a larger radius of an arc of the supporting surface, so that the two centers of rotation run in a line extending approximately parallel to a beating surface, the bearing surfaces being at an obtuse angle to one another in a prolongation of the smaller arc.

5 Claims, 1 Drawing Sheet

BEATER BAR CAPABLE OF BEING ACTED UPON ON ONE SIDE FOR IMPACTOR ROTORS

BACKGROUND OF THE INVENTION

The present invention relates to a beater bar capable of being acted upon on one side for impactor rotors.

More particularly, it relates to a beater bar which is capable of being inserted form-fittedly into circumferential slots of the rotors and which has rearwards, opposite to the direction of rotation of the rotors, and facing these, a bend of its elongate cross section, by means of which it engages into a longitudinally running undercut of the circumferential slots and is held counter to the centrifugal force of the rotating rotors, with bearing surfaces, by means of which the beater bar is held against a bearing surface of the rotors, and with a supporting surface, via which the beater bar is in engagement with the undercut in the circumferential slots by means of a supporting or bearing piece.

A beater bar of this type is known from U.S. Pat. No. 3,151,816. It has, on its rear side, a right-angled bend which engages under an undercut of the bearing surface of the circumferential slots in the rotor. The narrow side, facing the rotor, of the beater bar is bevelled, and against this bevel presses a wedge which is supported adjustably by means of pressure screws against the front surface of the circumferential slots which faces the beater bar. Exchangeable press plates are provided between the pressure screws and the front surface of the circumferential slots, and the wedge is additionally guided by lateral abutments. Fixing the beater bar in this way is complicated and costly, particularly since the parts necessary for this purpose are particularly exposed to wear at this point. The fastening of the beater bar is also unreliable, in that, if there is inadequate maintenance or inspection, the wedges may come loose in the rotating rotor, together with their pressure screws and the other aids, thus entailing the risk that the beater bar will fly out of its mounting and cause serious damage to the impactor. A sharp-edged undercut of the circumferential slots and the corresponding sharp-edged bend of the beater bar require accurate machining of the corresponding edges and surfaces, but are also undesirable because of the notch effects which may possibly occur here.

Beater bars capable of being acted upon on one side are known in many forms, even those which have bends or similar means for fastening. As a rule, they are fastened to the rotor body by means of wedges or wedge-shaped aids and additionally also by means of screw connections (U.S. Pat. No. 3,874,603, German patent specification 16 07 552, Australian patent specification 253,653), or they are pushed into circumferential recesses of disc rotors (DE-27 59 250 A1). Whilst in the case of the first-mentioned beater bars the fastening is complicated and they have the disadvantages described in more detail above, in the case of the last-mentioned beater bars there is additionally also the problem that the slots between the beater bars and the rotor contours surrounding these become clogged with fine material and obstruct the removal which is necessary after the wear of the beater bars.

Beater bars capable of being acted upon on one side are per se uneconomic because of their low wear potential. For a long time, therefore, beater bars have been used which are rotatable about their longitudinal axis and/or transverse axis and are inserted loosely into circumferential slots of the rotors (German utility pattern 1 831 058, DE 37 42 395 C1).

On account of the clearances in the form of gaps which are necessary for this purpose, even with these beater bars the gaps become clogged with fine material, and, besides, the rotation or turning of the beater bars is time-consuming and therefore costly. Also, these known beater bars have only a low degree of utilization because of their relatively large clamping height. However, in view of high wages, the maintenance costs are increasingly decisive as regards profitability.

SUMMARY OF THE INVENTION

Accordingly it is an object of the present invention to provide a beater bar which can easily be installed and removed in rotors of impactors and is also handy, which has a high wearing mass in relation to its total mass and which avoids the further disadvantages mentioned above.

Accordingly, it is an object of the present invention to provide a beater bar capable of being acted upon on one side and having a bend serving for fastening, this object is achieved in that the bend is of arcuate design and the centre of rotation of the smaller radius of the arc on the bearing surfaces is arranged at a considerable distance from the centre of rotation of the larger radius of the arc on the front/lower supporting surface, in the direction of the beating circle of the beater bar, and the two centres of rotation run in a line approximately parallel to the beating surface, the bearing surfaces being at an obtuse angle to one another in the prolongation of the smaller arc.

The beater bar according to the invention, which is capable of being inserted into circumferential slots, matched to its contour, of the impactor rotors, is therefore easily exchangeable, because, on the one hand, in the installed state, there are no slots or clearances between its bearing surfaces or its supporting surface and those surfaces of the circumferential slots which correspond to these, and, on the other hand, as a result of the arrangement of the centres of rotation of the arc radii in relation to one another, the beater bar, when tilted forwards, is immediately freed from its self-locking so as to open a gap. The arrangement of the centres of rotation of the radii and of the two boundary arcs of the bend of the beater bar also result in a small clamping height of the beater bar, in that the larger outer arc delimiting the lower and front supporting surface is provided further inwards towards the rotor. It is advantageous if the distance between the centres of rotation of the radii is in a ratio of 1:7 to 1:15, preferably 1:10, to the remaining height of the beater bar.

The invention also proposes that the obtuse angle between the bearing surfaces lying in the prolongation of the smaller arc amounts to 120°.

In a further refinement of the invention, the bend facing the rotor is provided on its end face with a segment-shaped recess extending over the length of the beater bar. It is expedient, where appropriate, to insert, between this recess and a corresponding recess in the circumferential slots of the rotors, a profile bar consisting preferably of plastic and having a round cross section, in order thereby to limit the tilting angle of the installed beater bar forwards during operation.

The novel features which are considered as characteristic for the present invention are set forth in particular in the appended claims. The invention itself, however both as to it construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
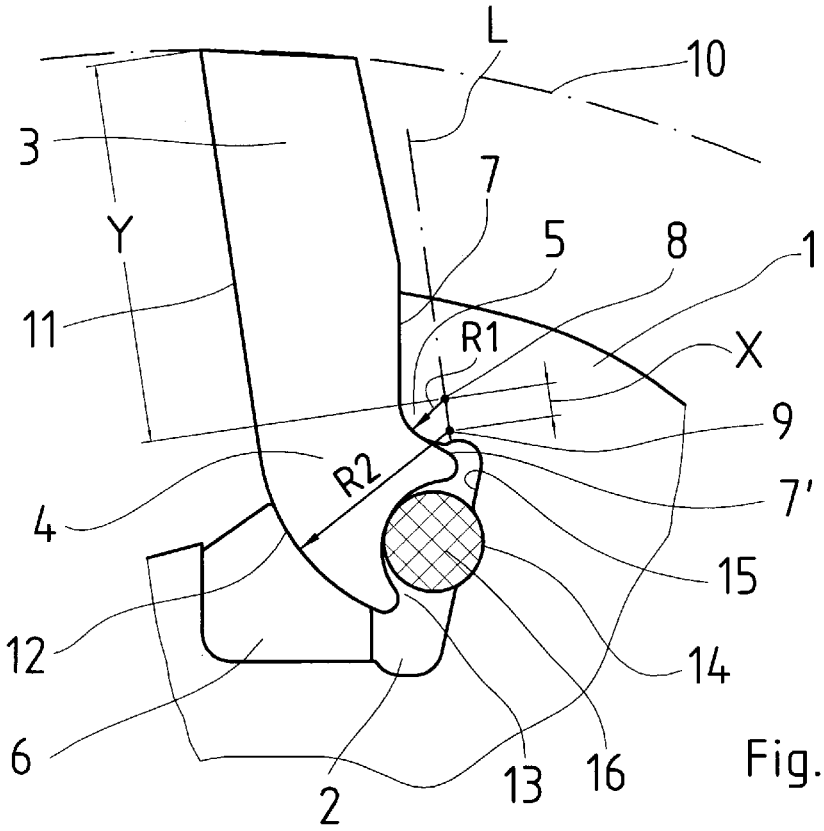
FIG. 1 shows a rotor portion with an installed beater bar in cross section, in accordance with the present invention.
Figure 2:
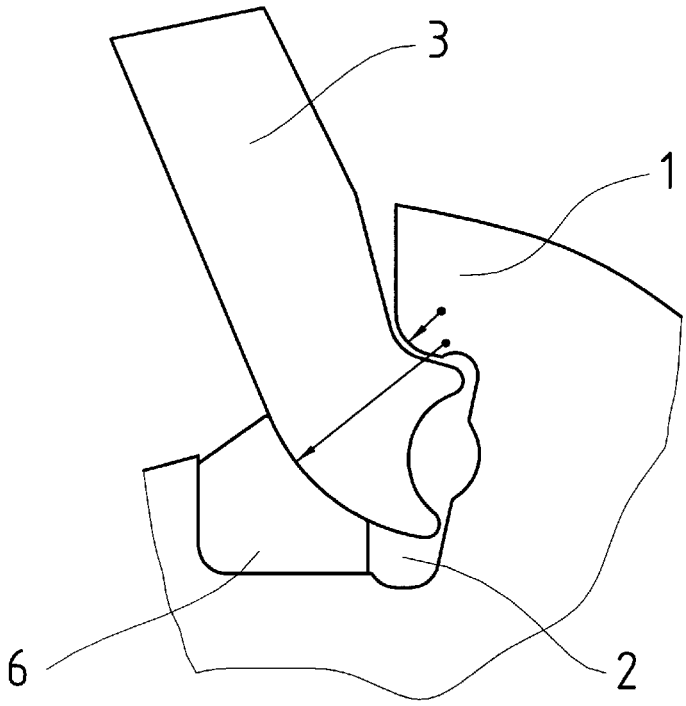
FIG. 2 shows the same rotor portion with a beater bar tilted forwards for the purpose of installation or removal, in accordance with the present invention.

In the figures, 1 designates the detail of a casing of an impactor rotor which has circumferential slots 2 running parallel to the rotor shaft, not shown. A beater bar 3 in accordance with the present invention is pushed from the side into each circumferential slot. The beater bar has, in cross section, an elongate profile of approximately the same thickness. The beater bar is provided, at its end seated in the circumferential slot, with an arcuate bend 4, by means of which it engages under an undercut 5 of the circumferential slot. The beater bar 3 is held in engagement with the undercut by means of a supporting or bearing piece 6 which is arranged exchangeably in the base of the circumferential slot. In this case, the beater bar is supported with its bearing surface 7 against an approximately radially oriented bearing surface of the circumferential slot, with the result that the energy of the rotating rotor is conducted into the beater bar.

Due to the arcuate bend 4 of the cross section and to the thickness of the beater bar, the front and rear sides of the beater bar have arcs of different extent, the centres of rotation of the radii of the arcs being arranged in a defined ratio to one another. Specifically, the centre of rotation 8 of the smaller radius R1 of the inner arc provided on the rear side of the beater bar is arranged at a distance X from the centre of rotation 9 of the larger radius R2 of the outer arc provided on the front side of the beater bar, in the direction of the beating circle 10, the distance X being expediently in a ratio of 1:10 to the remaining beater bar height Y, although this may differ depending on the size of the beater bar. Moreover, the two centres of rotation 8 and 9 are arranged in a line L which runs approximately parallel to the beating surface 11. The bearing surface 7 of the beater bar 3 merges into the smaller arc, the short surface provided at the run-out end of this arc being designated by 7'. These surfaces are at an angle of approximately 120° to one another.

The outer arc of the bend 4 serves as a supporting surface 12, by means of which the installed beater bar is supported against the supporting or bearing piece 6 in the base of the circumferential slot 2.

What is achieved by this design of the beater bar and by the way in which the beater bar is held in the rotor so as to be adapted to this design is that, in the working position, the beater bar is self-locked with its arcuate supporting surface 12 between the corresponding surface of the supporting or bearing piece 6 and the arcuately designed undercut 5 and is therefore fully secured against flying out of the rotating rotor. What is also achieved thereby, on the other hand, is that, when the beater bar is in the working position, there are no gaps, in which fine material can settle, between the bearing surfaces 7, 7' and the surfaces of the undercut 5 and also the supporting surface 12 of the beater bar 3 and the corresponding surfaces in the circumferential slots 2. It becomes very simple to remove the beater bar. This needs merely to be tipped somewhat forwards, with the result that, by virtue of the arrangement of the centres of rotation 8/9, the locking of the beater bar is released and gaps occur between the contact surfaces, so that the beater bar can easily be drawn out laterally.

So that, when the rotor 1 starts up or slows down, the installed beater bar 3 does not unintentionally tip down and rattle, this being made easier by the gaps which occur at the same time, the beater bar has, on that end face of the bend 4 which faces the rotor, a segment-shaped recess 13 which extends over the length of the beater bar and which matches with a corresponding recess 14 in the approximately radially extending boundary surface 15 of the circumferential slots 2 of the rotor, said boundary surface being oriented longitudinally over the rotor width. A round profile bar 16, which is expediently produced from plastic, can be introduced between these recesses which together form a circular cross section.

As the figures of the drawing make clear, the beater bar according to the invention is clamped in the rotor over a relatively short length, thus making a large wearing mass available. The beater bar thus has a high degree of efficiency.

It will be understood that each of the elements described above, or two or more together, may also find a useful application in other types of constructions differing from the types described above.

While the invention has been illustrated and described as embodied in beater bar capable of being acted upon on one side for impactor rotors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A beater bar actable upon on one side for impactor rotors and insertable form-fittedly into circumferential slots of the rotors, the beater bar comprising a beater bar member having rearwards, opposite to a direction of rotation of the rotors, and facing the rotors, a bend with an elongate cross-section for engagement into a longitudinally running undercut of the circumferential slots, bearing surfaces by which the beater bar member is heldable counter to a centrifugal force of the rotating rotors against a bearing surface of the rotors, a supporting surface by which the beater bar member is engageable with an undercut in the circumferential slot, and a beating surface, and a piece selected from the group consisting of a supporting piece and a bearing piece which holds the beater bar member in engagement with the undercut in the circumferential slot, said bend being of arcuate design, and a center of rotation of a smaller radius of an arc of said bearing surfaces being arranged at a considerable distance from a center of rotation of a larger radius of an arc of said supporting surface, in direction of a beating circle of the beating bar, and said two centers of rotation running in a line extending approximately parallel to a beating surface, said bearing surfaces being at an obtuse angle to one another in a prolongation of the smaller arc.

2. A beater bar as defined in claim 1, wherein a distance between said centers of rotation of said radii is in a ratio of 1:7 to 1:15 to a remaining height of the beater bar.

3. A beater bar as defined in claim 2, wherein the distance between the centers of rotation of the radii is in a ratio of 7:10 to the remaining height of the beater bar member.

4. A beater bar as defined in claim 1, wherein an obtuse angle between said bearing surfaces lying in the prolongation of the smaller arc is substantially 120°.

5. A beater bar as defined in claim 1, wherein said bend facing the rotor has an end face provided with a segment-shaped recess extending over a length of the beater bar member.

* * * * *